US009808139B2

(12) United States Patent
Francis

(10) Patent No.: US 9,808,139 B2
(45) Date of Patent: Nov. 7, 2017

(54) DISHWASHER PLACEMAT BASKET AND SUPPORT STRUCTURE

(71) Applicant: Ann Tran Francis, Reston, VA (US)

(72) Inventor: Ann Tran Francis, Reston, VA (US)

(73) Assignee: Ann Tran Francis, Reston, VA (US)

( * ) Notice: Subject to any disclaimer, the term of this patent is extended or adjusted under 35 U.S.C. 154(b) by 0 days.

(21) Appl. No.: 14/851,720

(22) Filed: Sep. 11, 2015

(65) Prior Publication Data

US 2016/0073852 A1 Mar. 17, 2016

Related U.S. Application Data

(60) Provisional application No. 62/048,901, filed on Sep. 11, 2014.

(51) Int. Cl.
*A47L 15/50* (2006.01)

(52) U.S. Cl.
CPC ..... *A47L 15/505* (2013.01)

(58) Field of Classification Search
CPC ... B65D 7/14; B65D 7/16; B65D 7/18; B65D 7/20; A47L 15/501; A47L 15/50
USPC ..... 211/41.8, 85.25; 220/487, 488
See application file for complete search history.

(56) References Cited

U.S. PATENT DOCUMENTS 1,602,291 A * 10/1926 Thibault ..... A47L 17/02 134/158
2013/0233353 A1* 9/2013 Vacca ..... A47L 15/501 134/25.2

* cited by examiner

*Primary Examiner* — King M Chu

(57) ABSTRACT

A dishwasher basket for securing placemats is disclosed. The basket provides multiple compartments and a planar base. Placemats of varying shapes and sizes can be secured for washing within a standard dishwashing machine. One configuration of the basket includes sinusoidal support walls such that standard placemat sizes can be secured and the basket located in a vertical orientation within the lower rack of a typical dishwasher. In addition, features on the basket side walls, base panel, and top panel are provided such that the dishwasher basket can be coupled to additional dishwasher baskets of the same configuration.

6 Claims, 11 Drawing Sheets

DISHWASHER PLACEMAT BASKET AND SUPPORT STRUCTURE

CROSS-REFERENCE TO RELATED APPLICATIONS

This application claims the benefit of U.S. Provisional Application No. 62/048,901, filed Sep. 11, 2014, the content of which is hereby incorporated by reference in its entirety

FIELD OF THE INVENTION

This invention relates to baskets used in dishwashing machines. The present device comprises a basket for supporting placemats.

BACKGROUND OF THE INVENTION

Conventional dishwashing machines include racks to support articles during a dishwashing cycle. There is a need for a specialized basket to support placemats for cleaning during a dishwashing cycle. In addition, typical placemats are of such flexibility they require support, as well as features to prevent the placemats from coming in contact with each other, and enabling both front and back surfaces of the placemat to be exposed to the washing fluids. In addition, typical placemats are of such dimensions that they will not fit in the lower rack of conventional dishwashers when stood in a vertical orientation, on long or short ends if rectangular, or on edge if circular. The invention claimed herein solves these problems.

BRIEF SUMMARY OF THE INVENTION

A dishwasher basket for securing placemats is disclosed and claimed. The basket includes multiple compartments, a base panel, top panel, placemat support walls, and side walls. It is an aspect of the current invention to provide a dishwasher basket which supports placemats within a dishwashing machine for cleaning during a dishwashing cycle. It is one aspect of the present invention that comprises multiple placemat support walls configured to support placemats within the support volume of the basket. The placemat support walls are provided with a plurality of openings extending through the placemat support walls. The base panel, side walls, and top panel contain a plurality of openings extending through their walls also. Frame front and frame rear panels can also be included in certain embodiments of the basket and contain openings extending through their structure as well. The openings are configured to permit fluids through the placemat support walls, base panel, side walls, and top panel, while restraining the placemats in a sinusoidal surface or planar orientation.

In one embodiment, the basket is defined by sinusoidal placemat support walls to fit placemats of typical dimensions which would exceed the height available from lower rack to upper rack when oriented vertically and located within the lower rack in typical dishwashing machines. It is an aspect of this embodiment that it can also be oriented horizontally and located within the upper rack in typical dishwashing machines.

In another embodiment, the base panel, top panel, and side walls are configured with features which provide the ability to join the basket to additional baskets. This aspect provides that multiple placemat baskets can be located within the upper or lower racks of typical dishwashing machines. In another aspect, the basket does not include side walls, and the placemat support walls include edge features which act as side walls, and also permit the placemat support walls to connect to one another.

In another embodiment, the basket is defined by planar placemat support walls to fit placemats of typical dimensions when oriented vertically and located within the lower rack space permitting, or when oriented horizontally and located within the upper rack of typical dishwasher machines. It is an aspect of the dishwasher basket to secure placemats of varying shapes and sizes including, but not limited to, rectangular, elliptical, circular and other geometric and non-geometrically shaped placemats. The dishwasher basket can also support within it other flexible items such as bibs, flexible cuttings boards or plastic sheets.

In another embodiment, the basket can be used outside of a dishwasher as a separate drying or storage device.

BRIEF DESCRIPTION OF THE DRAWINGS

For the purpose of understanding the foregoing and other aspects of the present invention, there are illustrated in the accompanied drawings in which.

REFERENCE NUMERALS IN THE DRAWINGS

Figure 1:
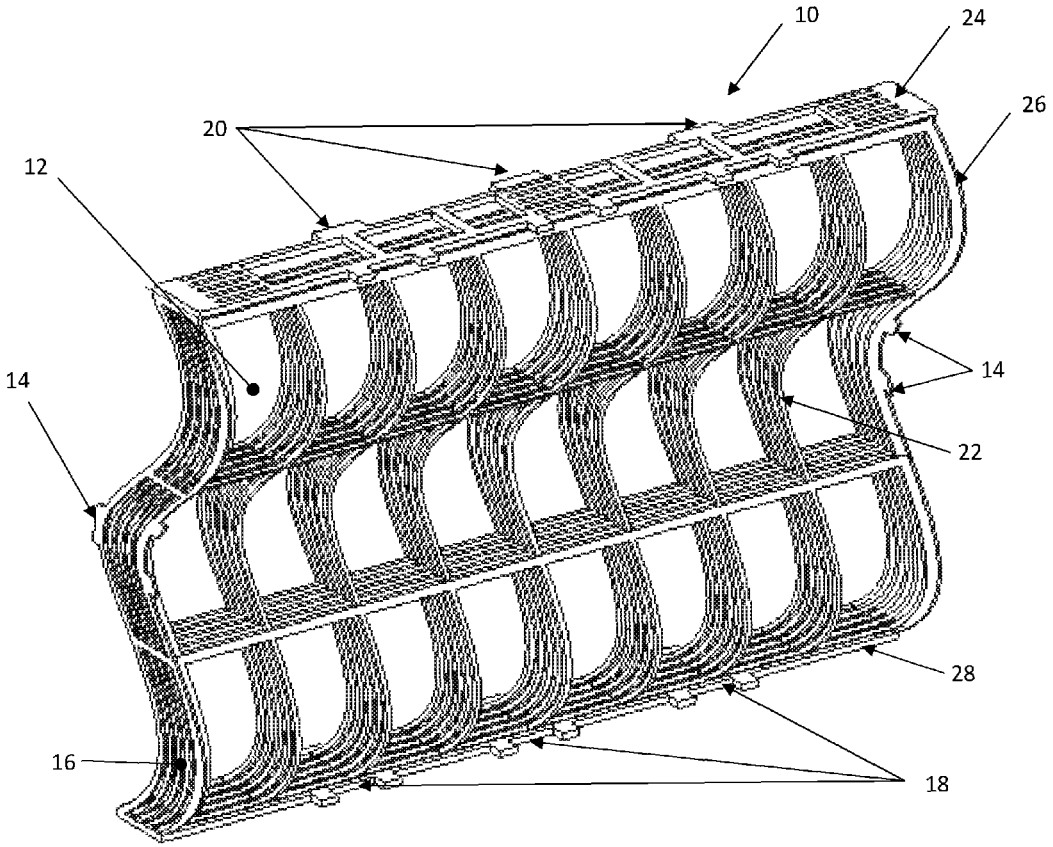
FIG. 1 depicts a perspective view of an embodiment of a the basket with one example of the present invention depicting sinusoidal placemat support walls.

10 Dishwasher Basket
12 Placemat support wall fluid pass-through opening
14 Side wall feature for assembling to additional dishwasher baskets
16 Side wall fluid pass-through opening
18 Base panel connecting feature for assembling to additional dishwasher baskets or dishwasher rack
20 Top panel feature for assembling to additional dishwasher baskets

22 Placemat Support wall
24 Top panel
26 Side wall
28 Base panel
30 Interior cavities to secure placemats
32 Placemat Support wall section
34 Base panel section
36 Top panel fluid pass-through opening
38 Top panel features for restraining placemat support walls
40 Side wall features for restraining placemat support walls
42 Base panel features for restraining placemat support walls
44 Base panel fluid pass-through opening
46 Placemat support wall features for restraining support wall to top panel or base panel
48 Placemat support wall edge for guiding and restraining placemat
50 Placemat support wall features for restraining support wall to side wall
52 Placemat support wall features for restraining the support wall to another support wall
54 Placemat frame front panel
56 Placemat frame rear panel

DETAILED DESCRIPTION

In the following description of embodiments, reference is made to the accompanying drawings which form a part hereof, and in which it is shown by way of illustration specific embodiments of claimed subject matter. It is to be understood that other embodiments may be used and changes or alterations, such as structural changes, may be made. All embodiments, changes or alterations are not departures from scope with respect to intended claimed subject matter. While this invention possesses the potential of embodiments in different forms, there is shown in the drawings and will herein be described in detail preferred embodiments of the invention with the understanding that the present disclosure should not be construed as limiting the scope of the invention.

A dishwasher basket for securing placemats is disclosed. The basket provides multiple compartments and a planar base. Placemats of varying shapes and sizes can be secured for washing within a standard dishwashing machine. One configuration of the basket includes sinusoidal placemat support walls such that standard placemat sizes can be secured and the basket located in a vertical orientation within the lower rack of a typical dishwasher. One configuration of the basket includes side walls. Another configuration of the basket does not require side walls, and the placemat support walls contain features which create side walls and connect to each other. An alternate configuration of the basket includes planar placemat support walls such that standard placemat sizes can be secured and the basket located in a horizontal orientation within the upper rack of a standard dishwasher. In addition, features on the basket side walls, base panel, and top panel are provided such that the dishwasher basket can be coupled to additional dishwasher baskets of the same configuration.

FIG. 1 depicts an embodiment of the basket 10 for a dishwasher. The basket 10 is intended to support placemats within a dishwashing machine for cleaning during a dishwashing cycle. In addition, dishwasher baskets herein may be used before, during and/or after the dishwashing cycle, but in and outside of a dishwasher, such as for a drying device.

FIG. 1 depicts a perspective view of an embodiment of the basket 10 in accordance with example aspects of the present invention. The basket 10 comprises multiple placemat support walls 22 configured to support placemats within the interior volume of the basket 10. The placemat support walls 22 are provided with a plurality of openings 12 extending through the placemat support walls 22 which provide fluid pass-through openings to clean the placemats. Fluid pass-through openings 16 are also provided in the side walls 26. In this manner, pathways to clean and drain can be found on the placemat support walls 22, top panel 24, base panel 28, and side walls 26 of the basket. In addition, features 14 in the side walls 26 are provided for assembling to additional baskets. Features 18 for assembling to additional baskets are provided in the base panel 28. Base panel 28 can have an additional feature for connecting to a dishwasher rack. Alternatively feature 18 can be used for connecting to a dishwashing rack. Also, features 20 in the top panel 24 for assembling to additional baskets are also provided.

Figure 2:
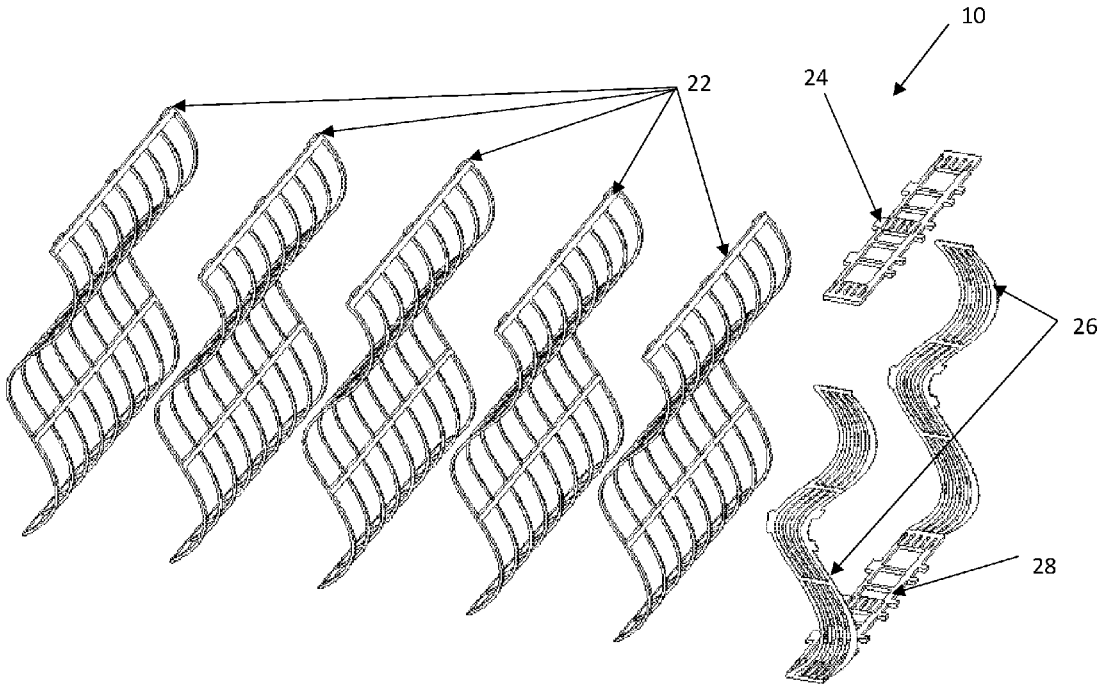
FIG. 2 depicts an exploded view of the embodiment illustrated in FIG. 1.

FIG. 2 depicts an exploded view of the embodiment illustrated in FIG. 1. Placemat support walls 22 are clearly shown. The top panel 24, which can be removable, fixed, or hinged is shown. Side walls 26 which may be integral or separate components from the base panel 28 or top panel 24 are identified. The connection of side wall 26 to base panel 28 or to top panel 24 can be an adjustable connection such as a hinged connection or a fixed connection. The connection of placemat support wall 22 to base panel 28 or to top panel 24 can be an adjustable connection such as a hinged connection or a fixed connection.

Figure 3:
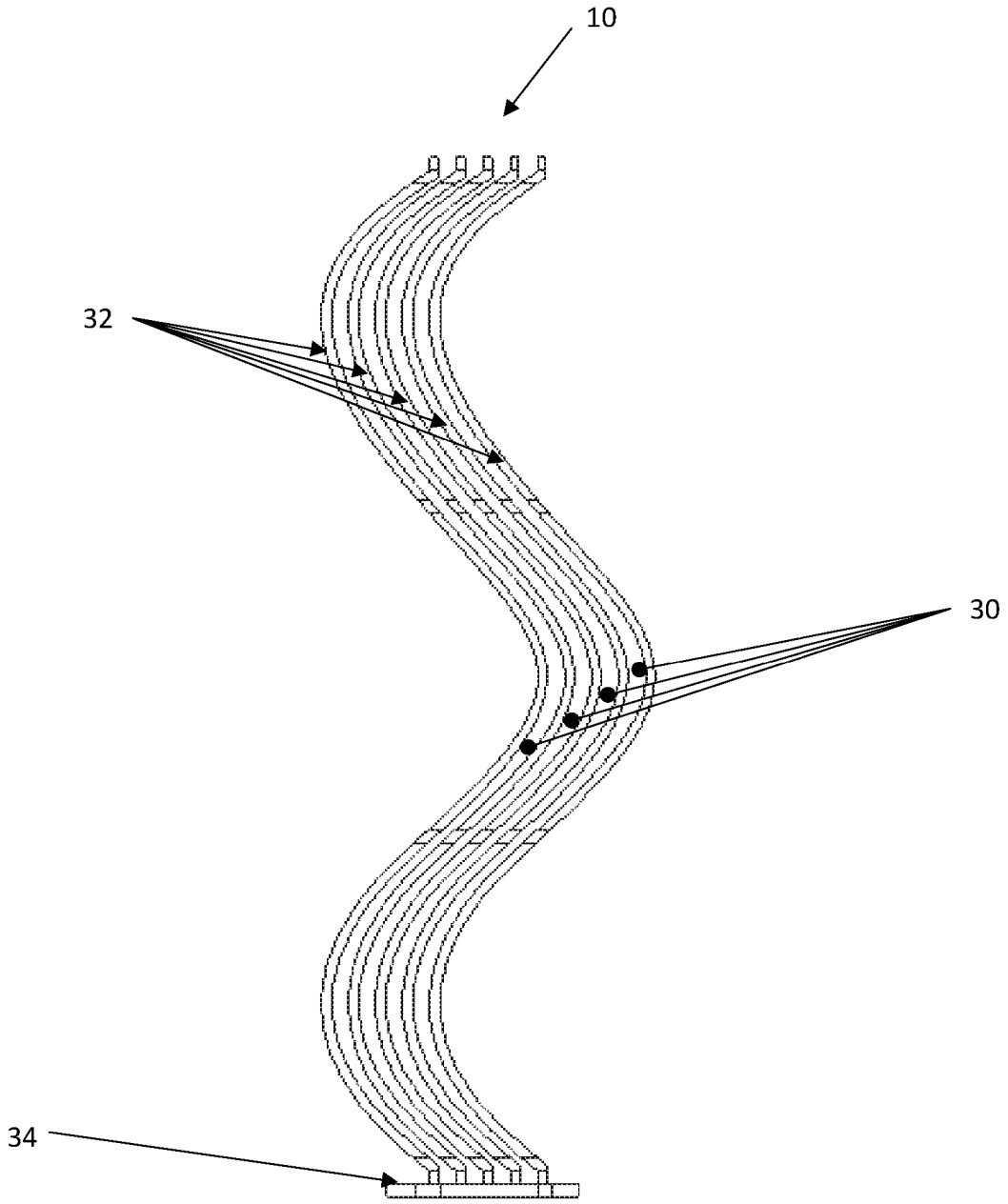
FIG. 3 depicts a sectional view of the embodiment illustrated in FIG. 1. identifying the sinusoidal placemat support walls and compartments for securing placemats.

FIG. 3 depicts a sectional view of the embodiment illustrated in FIG. 1. Interior cavities 30 to secure the placemats during the cleaning cycle as well as after the dishwashing cycle for draining are depicted. Placemat support wall sections 32 of sinusoidal configuration are shown which provide the necessary volume and height to accommodate placemats of typical dimensions. Base panel 34 section provides a planar base to support the basket in a vertical orientation when installed within a dishwashing machine on the lower rack or on a planar surface.

Figure 4:
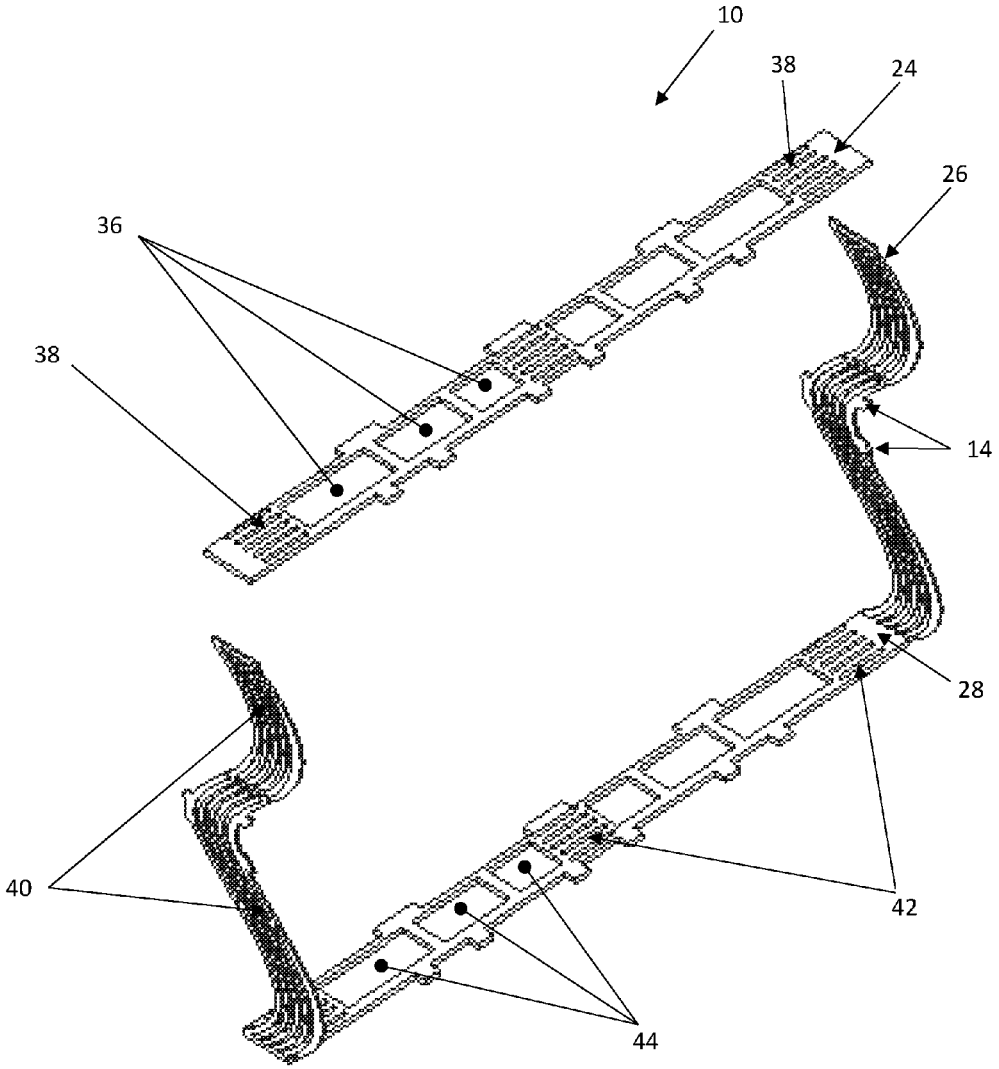
FIG. 4 depicts a perspective view of the embodiment illustrated in FIG. 1 of the basket with sinusoidal placemat support walls removed.

FIG. 4 depicts a perspective view of an embodiment of the basket 10 with sinusoidal placemat support walls 22 removed. Alternative embodiments of the dishwasher basket 10 can include where top panel 24, side walls 26, and base panel 28 can be a single integrated component or separate components that attach together to form the placemat basket. The top panel 24 contains fluid pass-through openings 36. The top panel 24 can be incorporated as an integral unit of the basket or a separate component. The top panel 24 contains features 38 for restraining support walls 22 are shown. Side walls 26 contain features to interface to base panel 28 and top panel 24, and features 40 to accept support walls 22. Base panel 28 contains features 42 for restraining placemat support walls 22 are shown. Base panel fluid pass-through openings 44 provide paths for fluid to cleanse and drain. An alternative embodiment allows for elimination of top panel 24.

Figure 5:
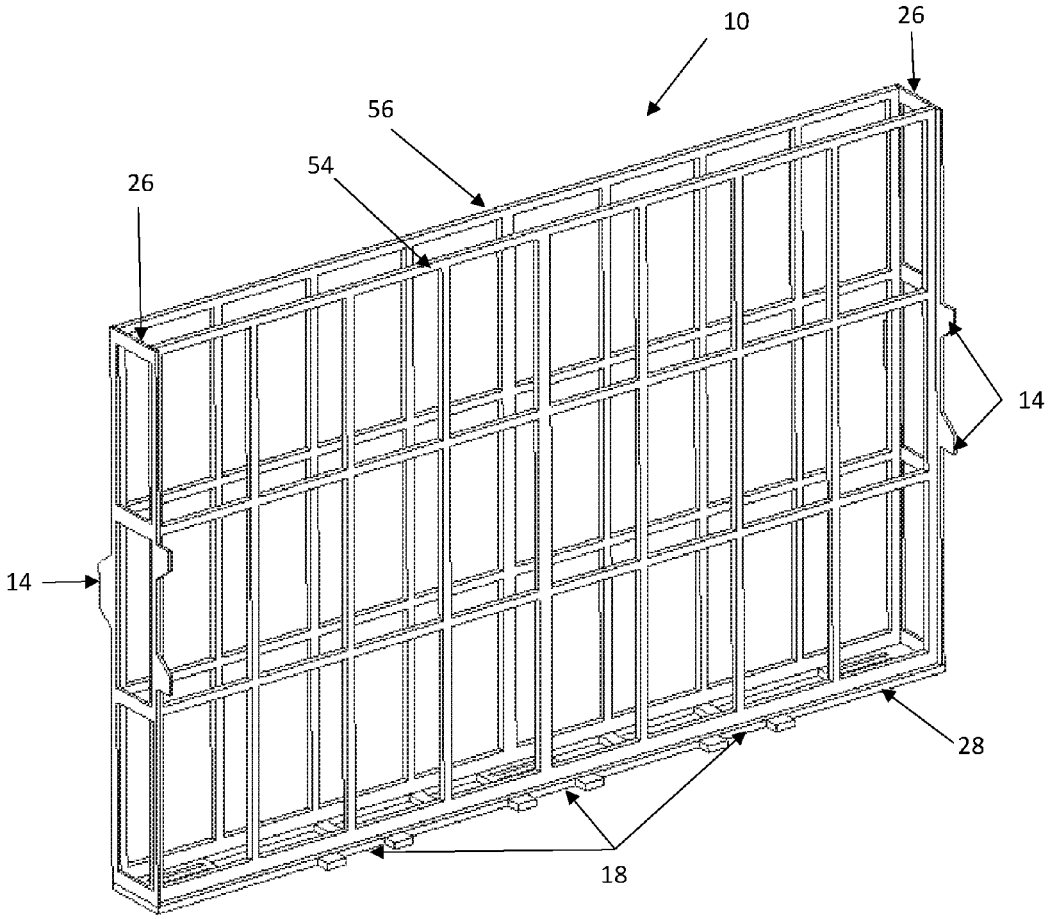
FIG. 5 depicts a perspective view of an embodiment of the dishwasher basket with one example of the present invention depicting planar frame front panel and frame rear panel, with planar placemat support walls removed.

FIG. 5 depicts a perspective view of an embodiment of the dishwasher basket 10 with frame front panel 54 and frame rear panel 56. The frame front and frame rear panels can be integral to the basket or removable, separate components. The frame front panel 54 and frame rear panel 56 can act as support walls when integrated into the basket 10. The frame front panels 54 and frame rear panel 56 can be fixed or on adjustable connections to the base panel 28, or to either side wall 26. An option top panel 24, not shown, can be incorporated into the embodiment of FIG. 5.

Figure 6:
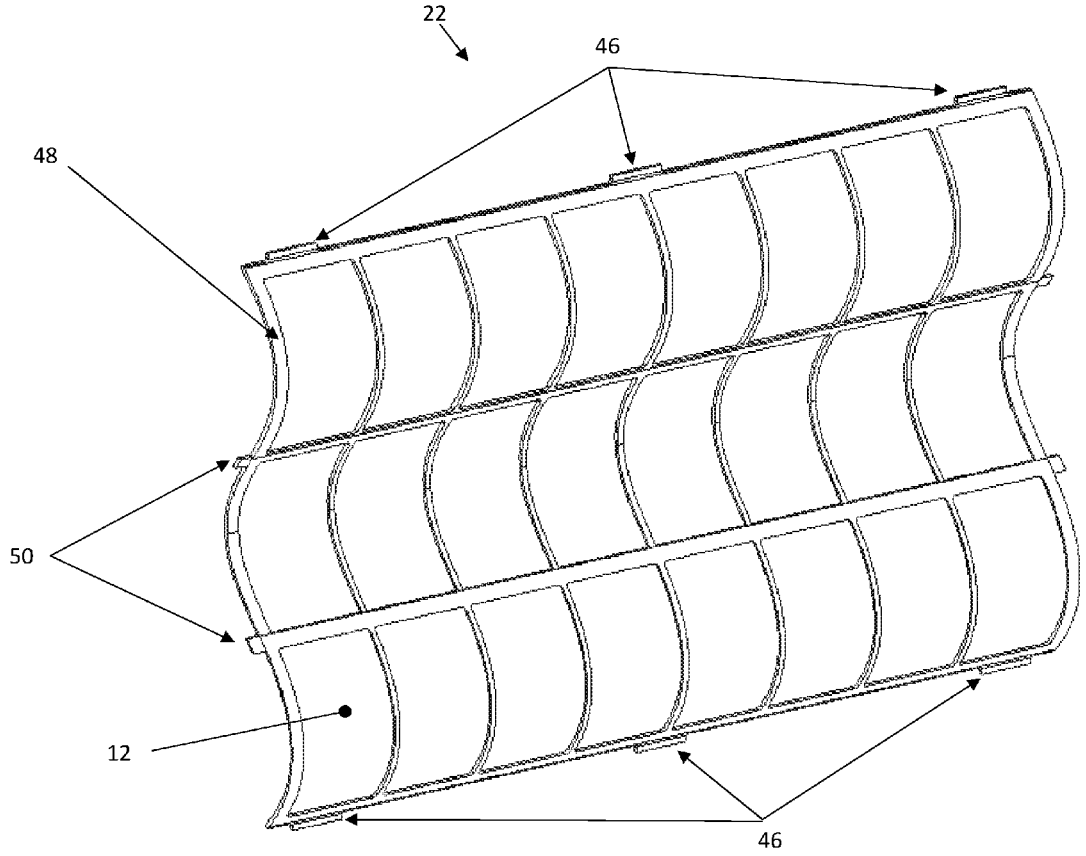
FIG. 6 depicts a perspective view of an embodiment of the sinusoidal placemat support wall which contains features for connecting to the side walls and the top and base panels.

FIG. 6 depicts a perspective view of an embodiment of the sinusoidal placemat support wall 22. The support walls 22 contain a plurality of openings 12 extending through the support walls 22. The openings are configured to permit fluids through the support walls 22 while restraining the placemats in a planar or curved surface orientation. Support wall features 46 for restraining support wall to top panel 24, base panel 28, or an adjacent support walls 22 are shown. Support wall edge 48 for guiding and restraining placemats is identified. Support wall features 50 for restraining support wall to side walls 26 or an adjacent support wall 22 are also shown.

Figure 7A:
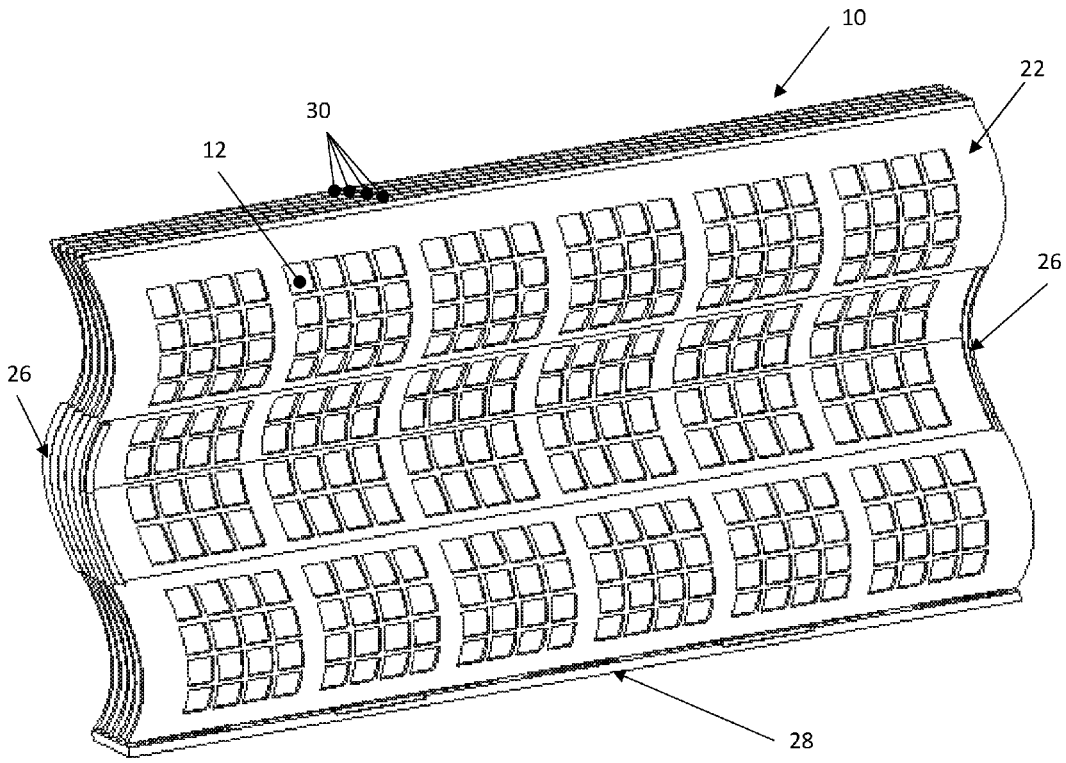
FIGS. 7A and 7B depict perspective views of embodiments of the basket where the side walls and base panels are separate components and do not meet.
Figure 7B:
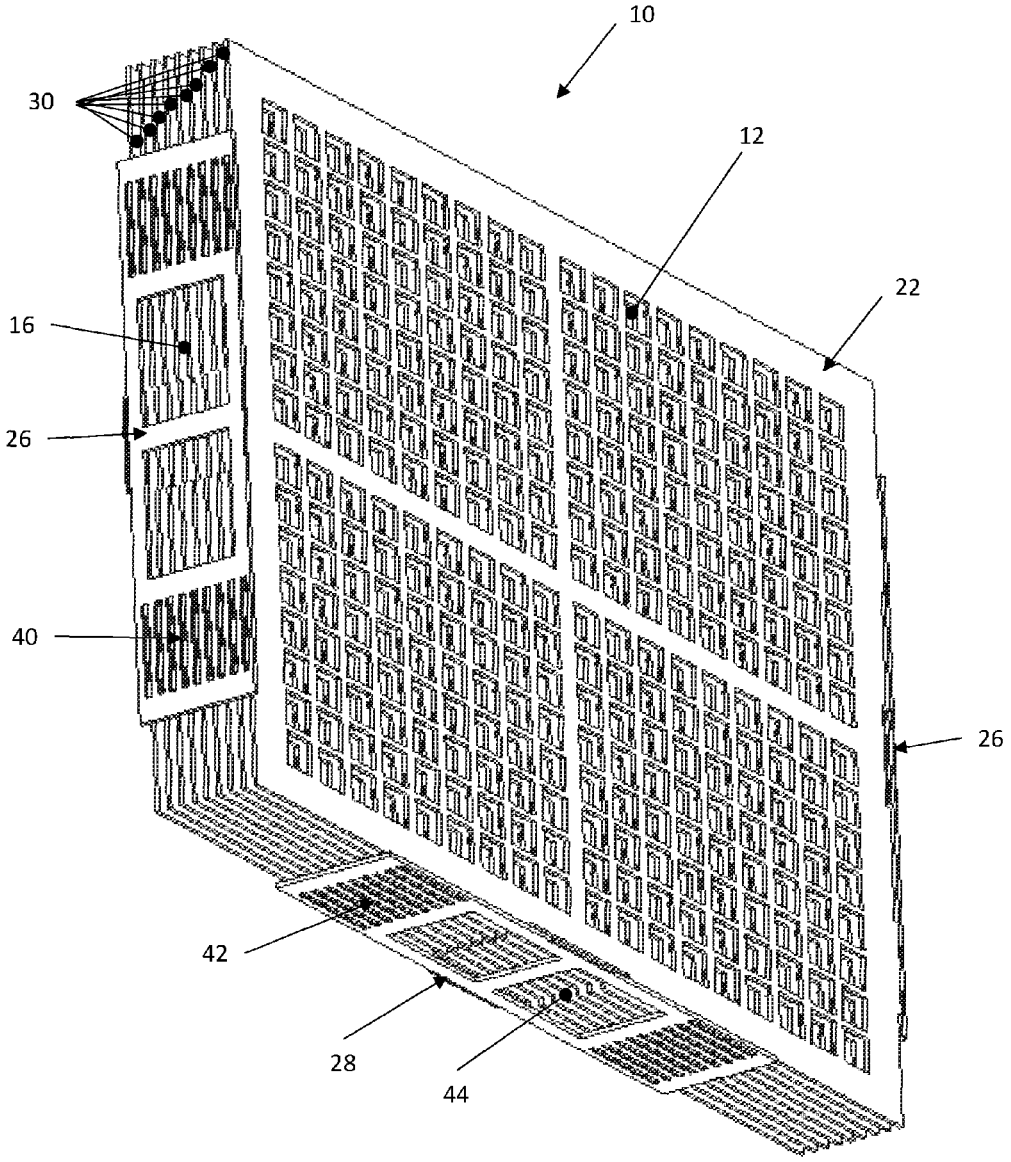

FIG. 7A and FIG. 7B depict perspective views of an alternative embodiment of FIG. 5 that allow for support wall 22 to connect to a side wall 26 on each side by feature 50 (not shown) and to a base panel by feature 45 (not shown). FIG. 7A depicts a sinusoidal embodiment and FIG. 6B illustrates a planar embodiment. In these embodiments the side wall 26 and base panel 28 do not necessarily connect to each other. The side walls 26 need not run the entire length of the side and base panel 28 need not run the entire length of the base as illustrated in FIG. 7B. The side walls 26 or base panel 28 can run the entire length as base panel 28 is depicted in FIG. 7A. Each support wall 22 connects on each side to side walls 26 by feature 50 (not shown) and at the bottom by feature 46 (not shown) to base panel 28 to create the basket 10. Feature 46 at the top (not shown) can be designed and used to retain items within the internal volume between support walls 22 or to connect to a top panel 24 (not shown). Each side wall 26 can contain a feature 14 for connecting to other dishwasher baskets and base panel 28 can have a feature for connecting to a dishwasher rack.

Figure 8:
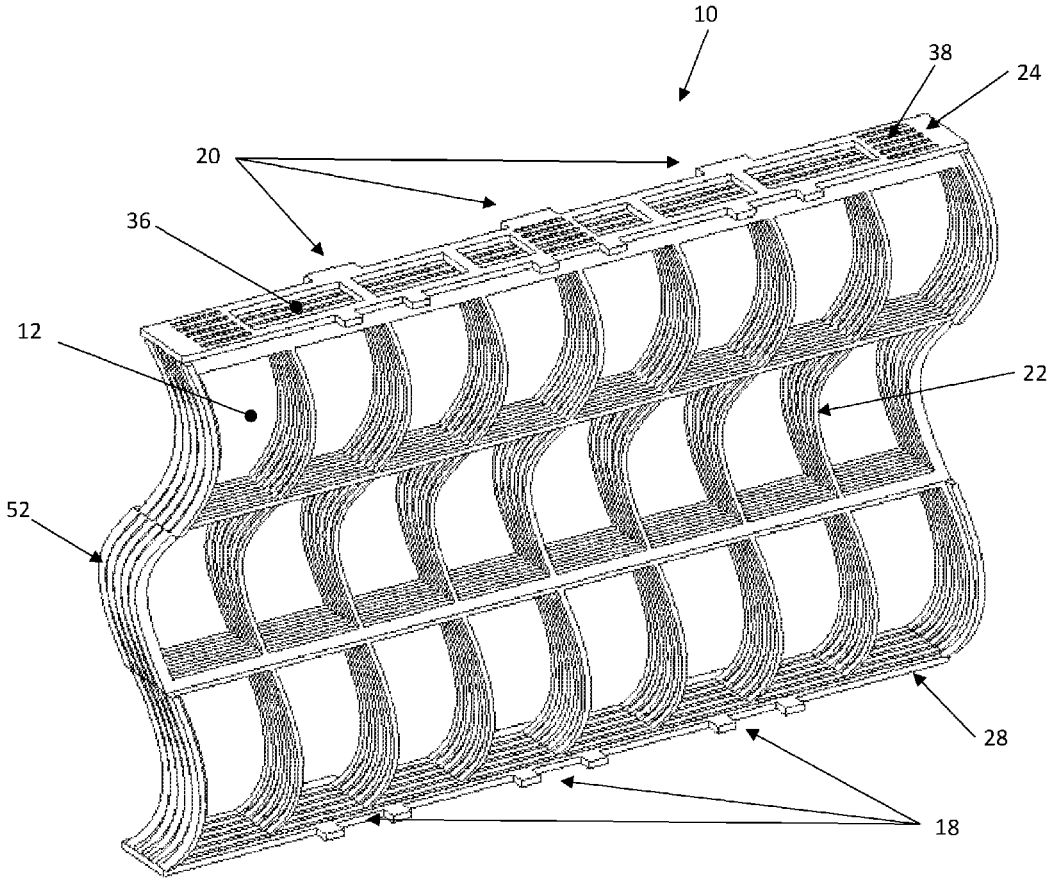
FIG. 8 depicts a perspective view of an embodiment of the basket with one example of the present invention depicting placemat support walls which contain features which create side walls eliminating the need for separate side wall components.

FIG. 8 depicts a perspective view of another embodiment of the basket 10 in accordance with example aspects of the present invention implementing placemat support walls which contain features which create side walls and connect one support wall to another. The dishwasher basket 10 comprises multiple placemat support walls 22 configured to support placemats within the interior volume of the basket 10. The placemat support walls 22 are provided with a plurality of openings 12 extending through the placemat support walls 22 which provide fluid pass-through openings to clean the placemats.

Figure 9:
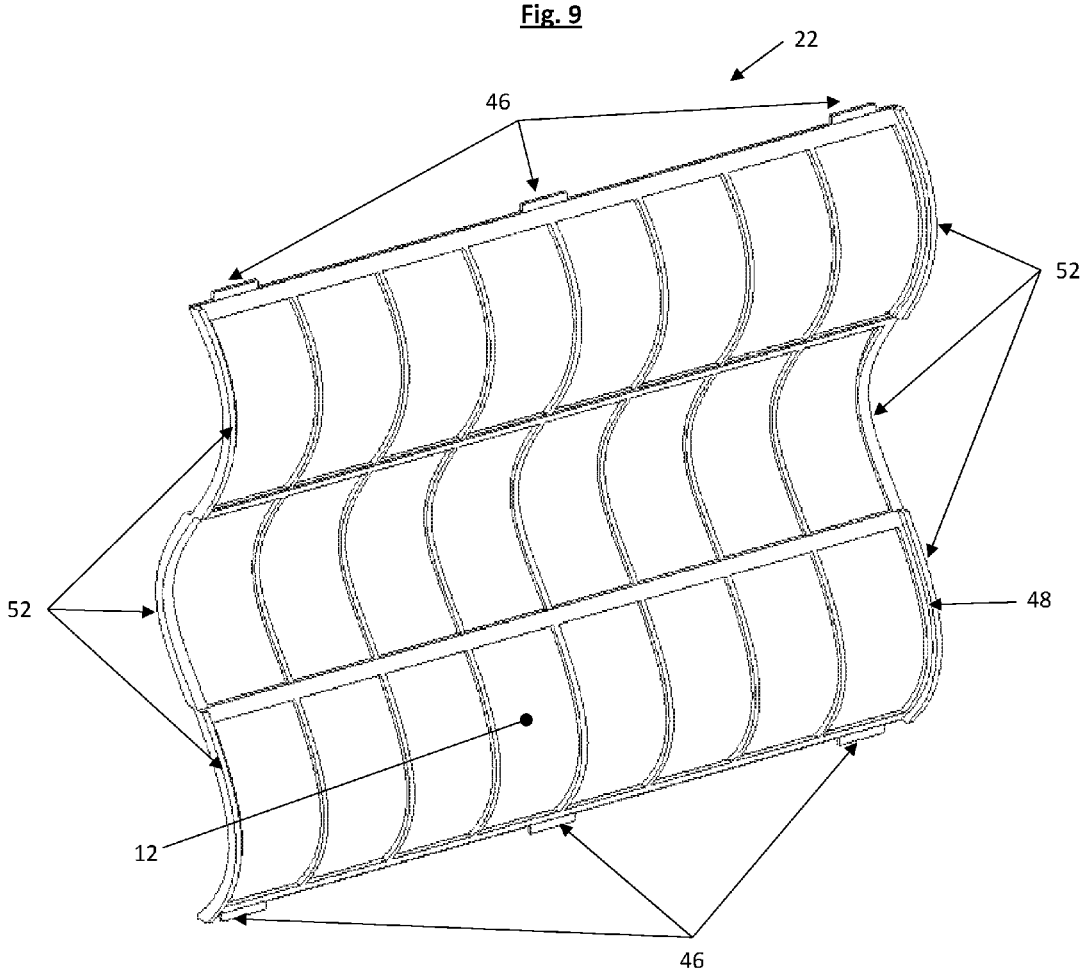
FIG. 9 depicts a perspective view of an embodiment of the sinusoidal placemat support wall which contains features which create side walls and connect to additional sinusoidal placemat support walls.

FIG. 9 depicts a perspective view of another embodiment of the dishwasher basket sinusoidal support wall 22. The support walls 22 contain a plurality of openings 12 extending through the support walls 22. The openings are configured to permit fluids through the support walls 22 while restraining the placemats in a planar or curved surface orientation. Support wall features 46 for restraining support wall to top panel 24 or base panel 28 are shown. Support wall edge 48 for guiding and restraining placemat is identified. Support wall features 52 which contain features which create side walls and connect one support wall to another are depicted. Feature 46 can alternatively be used to for connecting the top and bottom of a support wall 22 to an adjacent support wall 22.

Figure 10:
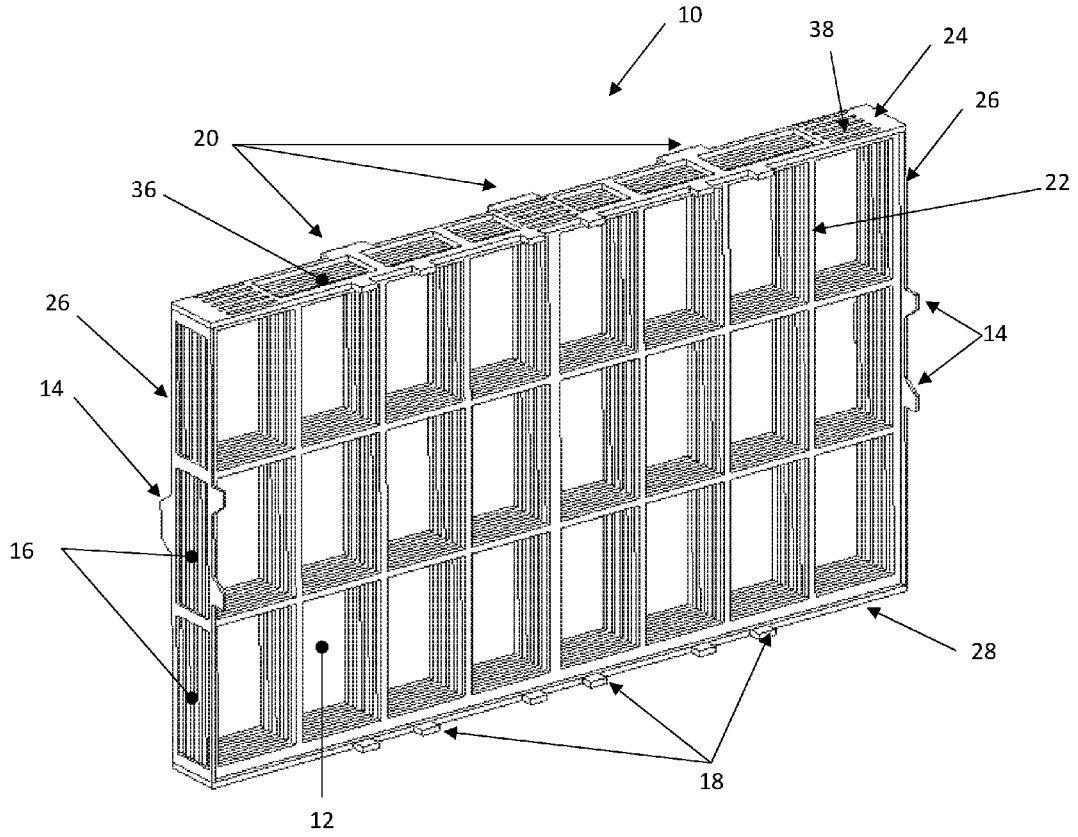
FIG. 10 depicts a perspective view of the embodiment illustrated in FIG. 5 of the basket with one example of the present invention depicting planar placemat support walls.

FIG. 10 depicts a perspective view of another embodiment of the basket 10 in accordance with example aspects of the present invention implementing planar placemat support walls. The dishwasher basket 10 comprises multiple placemat support walls 22 configured to support placemats within the interior volume of the basket 10. The placemat support walls 22 are provided with a plurality of openings 12 extending through the placemat support walls 22 which provide fluid pass-through openings to clean the placemats. Fluid pass-through openings 16 are also provided in the side walls 26. In this manner, pathways to clean and drain can be found on the support walls 22, top panel 24, base panel 28, and side walls 26 of the basket. In addition, features 14 in the side walls 26 are provided for assembling to additional baskets. Features 18 for assembling to additional baskets are provided in the base panel 28. Also, features 20 in the top panel 24 for assembling to additional baskets are also provided.

What is claimed is:

1. A dishwasher basket device for securing placemats within a dishwashing machine comprising:

a. two or more identical support walls configured in parallel and offset from one another by the thickness of one of the two or more identical support walls to support placemats or other flexible items extending within an interior volume of the basket created by the two or more identical support walls; and b. the two or more identical support walls are configured with a plurality of openings extending through the two or more identical support walls permitting fluid to pass through; and c. the two or more identical support walls are configured with connector features to connect the support wall to a base panel, at least two or more identical side walls, and a top panel; the connector features are adjustable connections selected from a fixed, hinged, or removable connections; and d. at least two side walls extending parallel to each other and perpendicular to the two or more identical support walls and perpendicular to the base panel; and e. the base panel extended perpendicular to the side walls and perpendicular to the two or more identical support walls; and f. the base panel and the at least two side walls are configured with a plurality of openings extending through the base panel or the at least two side walls permitting fluid to pass through, and;

g. the base panel and at least two side walls also contain the connector features to connect the two or more identical support walls to create one or more interior volumes; and h. the base panel is planar to support the dishwasher basket device in a vertical orientation when installed in a dishwasher or on a planar surface i. the two or more identical support walls are parallel, offset from one another by the thickness of one of the two or more identical support walls, and the two or more identical support walls are sinusoidal shape such that the dishwasher basket device can secure standard placemat sizes and be located in a vertical orientation within a lower rack of a typical dishwasher.

2. The device of claim 1, wherein the two or more identical support walls contains edges to guide and restrain placemats and to connect directly to additional support walls to create additional side walls perpendicular to the additional support walls and perpendicular to the base panel and to create internal volumes for securing placemats, eliminating the need for separate side wall components.

3. The device of claim 1, wherein the device further comprises the top panel connecting to each of the at least two side walls at the end of the at least two side walls opposite of which the at least two side walls connect to the base panel and the top panel can be an adjustable connection such as removable or hinged connection.

4. The device of claim 1, wherein the devices further comprises two frame panels comprising a front and rear frame panel, each of the frame panels connecting to each of the at least two side walls and the base panel on opposite sides of the base panel, each of the frame panel is perpendicular to the base panel and perpendicular to the at least two side walls, each of the frame panel is configured with a plurality of openings extending through the frame panels permitting fluid to pass through.

5. The device of claim 1, wherein the base panel, the at least two side walls, and the top panel include additional connector features allowing the attachment or coupling of the device of claim 1 to one or more additional devices of claim 1.

6. The device of claim 1, wherein the base panel contains connectors for connecting the device to a dishwasher rack.

* * * * *